United States Patent [19]

McKelvy

[11] 4,348,561

[45] Sep. 7, 1982

[54] MECHANICAL DEVICE FOR PICKING UP AN ELECTRICAL LOAD

[75] Inventor: Marvin D. McKelvy, Centralia, Mo.

[73] Assignee: A. B. Chance Company, Centralia, Mo.

[21] Appl. No.: 175,402

[22] Filed: Aug. 5, 1980

[51] Int. Cl.[3] ..... H01H 13/28

[52] U.S. Cl. ..... 200/51 R; 200/78

[58] Field of Search ..... 200/51 R, 78, 161, 318, 200/325; 339/9 R, 19, 222

[56] References Cited

U.S. PATENT DOCUMENTS

| | | | |
|---|---|---|---|
| 433,560 | 8/1890 | Detwiller | 200/78 |
| 1,586,124 | 5/1926 | Smith | 339/19 |
| 2,233,826 | 3/1941 | Allison | 200/51 R |
| 2,438,746 | 3/1948 | Garrison | 200/51 R |
| 2,563,335 | 8/1951 | Istrati et al. | 200/51 R |
| 2,570,438 | 10/1951 | Flagge et al. | 200/78 |
| 2,585,749 | 2/1952 | DiLorenzo et al. | 200/325 |
| 3,156,800 | 11/1964 | Date | 200/78 |
| 4,281,228 | 7/1981 | Harmon | 200/51 R |

*Primary Examiner*—John W. Shepperd

*Attorney, Agent, or Firm*—Schmidt, Johnson, Hovey & Williams

[57] ABSTRACT

A hot line load pick-up hand tool for use in electrical transmission and distribution systems has improved electrical conductivity and is capable of temporarily picking up and safely carrying high voltages being transmitted by energized main and branch feeder cables and transferring current therefrom to non-energized distribution lines prior to and during installation of permanent current transfer connections, all without any likelihood of damage to the cables or appreciable danger to workmen. Trip mechanism for closing the circuit through the tool after installation can only be reset prior to being placed in use, and the tool is inherently incapable of permitting breaking of the circuit while it is in place clamped to the main line. The entire tool is easily and quickly disassembled for inspection and cleaning of all its component parts.

8 Claims, 6 Drawing Figures

Fig. 1.
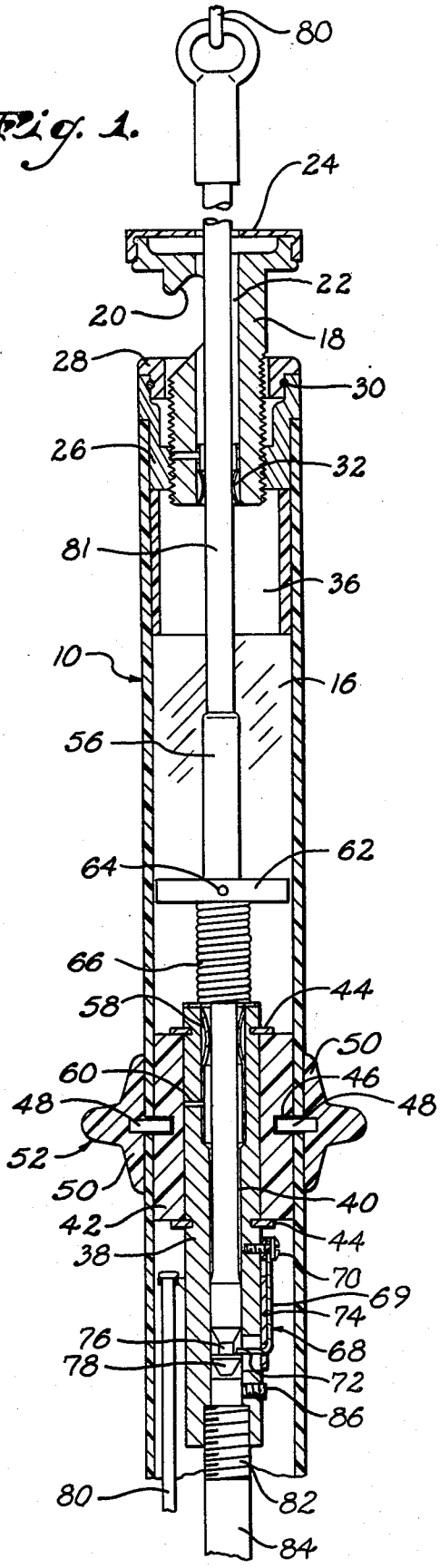
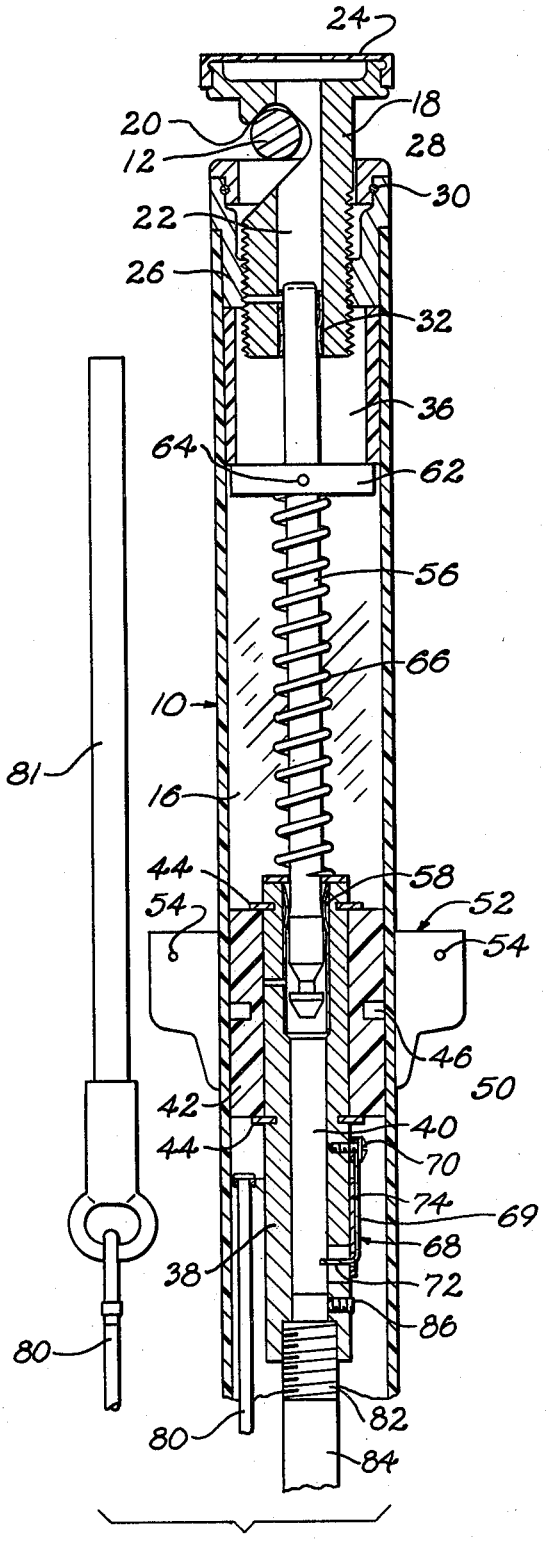
Fig. 2.

MECHANICAL DEVICE FOR PICKING UP AN ELECTRICAL LOAD

Safety being of prime importance in the design of equipment for use with high power electrical transmission and distribution systems, the load pick-up hand tool forming the subject matter of my present invention has a built-in trip mechanism which can only be actuated while the tool is disengaged and removed from the main, high power transmission line. Accordingly, after the tool has been clamped in place on the lines to be mechanically and electrically interconnected thereby, and the mechanism is tripped to close the circuit through the tool, it is impossible for the workman to inadvertently or purposefully break the circuit by further actuation of the trip mechanism.

To this end, a lanyard leading from within the tool is pulled, thereby releasing a spring-loaded latch previously set to hold a conductive rod out of engagement with one of a pair of contacts. Spring means thereupon forces the rod into bridging relation to the contacts, closing the circuit through the rod and between the interconnectec lines.

Prior setting is accomplished through manual use of a pusher device acting on the rod to force it against the action of the spring to a position of snap-action interlock with the latch, but such setting can only take place when the clamp of the tool is removed from the power line. A transparent sight tube permits visual inspection of the position of the circuit-closing, reciprocable rod within the tube.

Exteriorly of the tube there is provided a releasable, split collar which, when removed from the tube, releases component parts contained in the tube. All such parts may then be easily removed from the tube, inspected, cleaned and/or replaced prior to reassembly with minimum time requirements and skill.

A related presently pending U.S. patent application owned through recorded assignment by the assignee of this application, Ser. No. 25,903 entitled "Tool For Making And Breaking Load Circuits", was filed Apr. 2, 1979 in the name of Robert W. Harmon.

An example of a connector element having a hook for looping over a live conductor and a reciprocable, spring-loaded contact head for direct live line engagement is the device disclosed in U.S. Pat. No. 2,237,588 issued Apr. 8, 1941. No safety feature is provided for precluding use of the tool to break the circuit and rearming it while clamped by the contact head to the live line.

In the drawings:

FIG. 1 is a longitudinal cross-sectional view through the mechanical device for picking up an electrical load made pursuant to the instant invention;

FIG. 2 is a view similar to FIG. 1 except for 90° rotation of the tube relative to its contained parts and, in contrast to FIG. 1, showing the conductive rod released;

Figure 3:
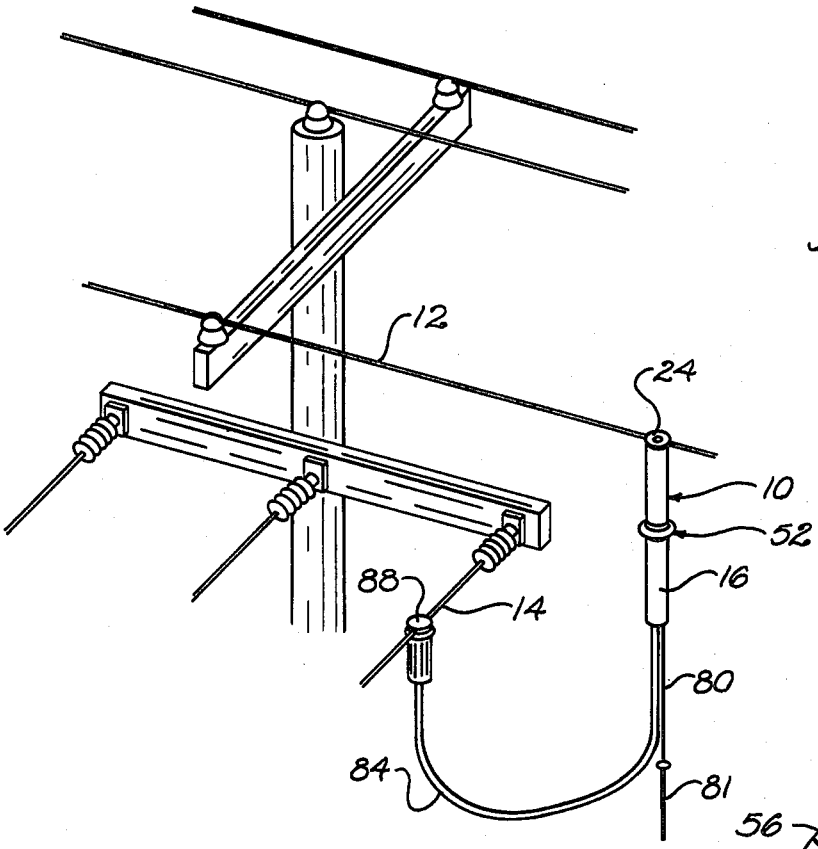
FIG. 3 is a perspective view showing the tool clamped to the lines.
Figure 4:
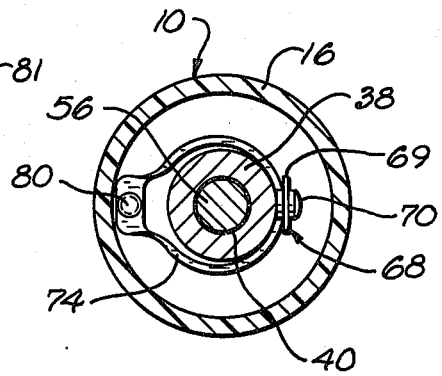
FIG. 4 is a cross-sectional view taken on line 4—4 of FIG. 5.
Figure 5:
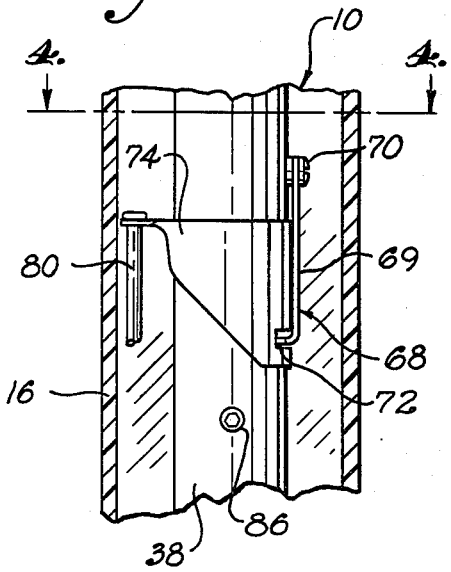
FIG. 5 is an enlarged fragmentary cross-sectional view similar to FIGS. 1 and 2 but showing the trip lever in side elevation.
Figure 6:
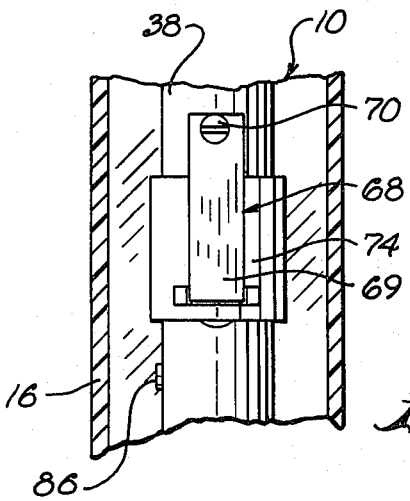
FIG. 6 is a view similar to but at right angles to FIG. 5, showing the latch in side elevation.

A load pick-up tool 10, for transferring electrical current from an energized conductor 12 to a non-energized conductor 14, has an elongated, transparent tube 16 made, for example, from a polycarbonate. A conductive head 18 at one end of the tube 16 has a hook 20 and a passage 22 therethrough coaxial with the tube 16. A perforated elastomeric protective cap 24 is snap-fitted over the outer end of the head 18.

A nut 26, made from bronze or the like, tightly fitted into the tube 16, receives the external screw threads of the head 18. A flanged ring 28, which may also be made from bronze, surrounds the head 18 and is held in place within the nut 26 by a wire snap ring 30. A fingered, tubular, fixed, electric contact 32 is held within the inner end of the passage 22 by a rivet or the like (not shown) and a short stop tube 36 is fitted within the tube 18 in abutment with the nut 26.

Certain of the parts and arrangements thus far described are similar to that disclosed in U.S. Pat. No. 2,114,736 issued Apr. 19, 1938.

An elongated conductive guide 38 in the tube 16 has a bore 40 therethrough coaxial with the tube 16, and is surrounded by a bushing 42 within the tube 16. The guide 38 is provided with spaced grooves therearound which receive a pair of split washers 44 between which the guide 38 is confined. The bushing 42 is also surrounded by a groove 46 which receives a pair of diametrically opposed pins 48 that pass through the tube 16. The pins 48 extend into corresponding sections 50 of a split collar 52 surrounding the tube 16 and releasably interconnected by fasteners 54.

The guide 38 supports an elongated, conductive rod 56 for rectilinear reciprocation within the bore 40 toward and away from the contact 32. The rod 56 passes through and slidably engages a second, fingered, tubular, fixed, electric contact 58 held within the bore 40 at the inner end of the latter by a rivet 60. An insulated disc guide 62 for the rod 56 surrounds the latter and is attached thereto by a set screw 64. A spring 66, coiled about the rod 56, is interposed between the guides 38 and 62.

An L-shaped spring latch 68 has one leg 69 thereof attached to the guide 38 by a fastener 70 and the short leg 72 thereof passing through aligned openings in a lever 74 and in the guide 38, terminating within a groove 76 surrounding the rod 56. A conical end 78 is provided on the rod 56 for deflecting the leg 72. The lever 74 is interposed between the leg 69 and the guide 38 and surrounds the latter. A flexible lanyard 80 is fastened to the lever 74 in diametrically opposed relation to the leg 69 and extends outwardly beyond the open end of the tube 16. A stiff, elongated, fiber-reinforced push device 81 is attached to the outer end of the lanyard 80.

The guide 38 is internally tapped to receive external screw threads of a plug type electric terminal 82 on one end of a suitable length of electric cable 84, a set screw 86 being provided to hold the terminal 82 against rotation relative to the guide 38. The insulated cable 84 extends through and beyond the open end of the tube 16 and has an insulated, electric jumper clamp 88 attached to its outer end.

OPERATION

The device 81 is inserted into the tool 10 through the cap 24 and the passage 22 to push on the rod 56 against the action of the spring 66 (compressing the latter) until the end 78 deflects the leg 72 and the latter snaps into the groove 76. Such compression of the spring 66 is readily visible to the operator through the tube 16. The device 81 is then removed from the tool 10.

The hook 20 is then used to snare the conductor 12 and the tube 16 is rotated until the conductor 12 is clamped tightly against the ring 28. It is to be noted at this juncture that, because the guide 38 is free to rotate inside the bushing 42, when the tube 16, the collar 52 and the bushing 42 are rotated relative to the head 18, no such rotation is imparted to the guide 38, the rod 56, the lanyard 80 or the cable 84. The clamp 88 is then connected to the conductor 14 whereupon the operator pulls on the lanyard 80 to trip the lever 74. This deflects the leg 69 to withdraw the leg 72 from within the groove 76, causing the rod 56 to move into engagement with the contact 32 therewithin by the action of the spring 66.

Once the electrical current is thus transferred from the energized, high voltage transmission conductor 12 to the line conductor 14, picking up the load on the latter, as a safety factor, it is not possible to break the circuit established by the rod 56 between the contacts 32 and 58 as long as the head 18 is clamped to the conductor 12.

Thereupon a permanent electrical connection can be made between the conductors 12 and 14 in parallel with the tool 10, all without need for deenergizing the conductor 12, following which the tool 10 is removed while the rod 56 is still bridging the contacts 32 and 58.

Assembly and disassembly of all the component parts of the tool 10 can take place easily and quickly. Release of the fasteners 54 permits removal of the collar 52 from the tube 16 and removal of the pins from the bushing 42 and tube 16. After slipping of the bushing 42 from within the tube 16, it can be removed from the guide 38 by release of the washers 44.

In a tool heretofore manufactured and sold by my assignee, the bushing 42, the washers 44, the pins 48 and the collar 50 were not provided, rendering the guide 38 and its associated parts reciprocable in the tube 16 toward and away from the open end of the latter. A secondary tube was provided in the tube 16 connected at one end thereof with the guide 38 adjacent the fastener 70, with the secondary tube surrounding the guide 38 inwardly of the fastener 70.

At its opposite end the secondary tube was connected to the head 18 adjacent the inner end of the latter in surrounding relation to the contact 32. The secondary tube surrounded a metal guide 62, the spring 66 and the rod 56. The set screw 64 extended through and was reciprocable within a longitudinal slot in the secondary tube, such slot extending from adjacent the head 16 inwardly toward the guide 38.

Accordingly, to withdraw the rod 56 from within the contact 32, compressing the spring 66 and setting the latch 68, the tube 16 was rotated relative to the head 18 completely releasing the latter from the nut 26. Then the tube 16 was pulled away from the head 18 causing the latter to pull the secondary tube and the guide 38 until the set screw engaged the stop 36. Continued outward movement of the head 18 away from the tube 16 would then compress the spring 66 and cause the leg 72 of the latch 68 to snap into the groove 76. The head 18 would thereupon be reinserted into the nut 26. Therefore, it was possible to break the engagement of the rod 56 with the contact 32 within the latter while the head 18 was still looped over the conductor 12.

I claim:

1. A load pick-up tool for transferring electrical current from an energized conductor to a non-energized conductor, said tool comprising:

an elongated dielectric tube;

a conductive head secured to the tube at one end of the latter;

said head having means for clamping the same to an energized conductor and being provided with a first, fixed electric contact;

an elongated, tubular, conductive guide in the tube spaced from said head;

means holding the guide against movement relative to the tube toward and away from the head, said guide having means for connecting the same to a non-energized conductor and being provided with a second, fixed electric contact;

an elongated, conductive rod in the guide, said guide supporting the rod for rectilinear reciprocation longitudinally of the tube and the guide along the longitudinal axis of the rod toward and away from said first contact;

a releasable latch in the tube engageable with the rod for holding the rod at one end of its reciprocable path of travel remote from the first contact;

means operably connected to said latch for selectively releasing said latch for disengagement of said rod from said latch; and spring means in the tube for forcing the rod toward the opposite end of its path of travel upon release of said latch, said rod engaging both contacts when the rod is at said opposite end of its path of travel and having a latch-receiving groove at one end thereof remote from the first contact, said latch being L-shaped, being mounted on the guide and having a leg disposed within the groove when the rod is at said one end of its path of travel, said head having a passage therethrough for receiving an elongated device used to push the rod to said one end of its path of travel against the action of the spring.

2. The invention of claim 1, said rod having means on said one end thereof for deflecting the leg when the rod is pushed to said one end of its path of travel.

3. A load pick-up tool for transferring electrical current from an energized conductor to a non-energized conductor, said tool comprising:

an elongated dielectric tube;

a conductive head secured to the tube at one end of the latter, said head having means for clamping the same to an energized conductor and being provided with a first, fixed electric contact;

an elongated, tubular, conductive guide in the tube spaced from said head;

means holding the guide against movement relative to the tube toward and away from the head, said guide having means for connecting the same to a non-energized conductor and being provided with a second, fixed electric contact;

an elongated, conductive rod in the guide, said guide supporting the rod for rectilinear reciprocation longitudinally of the tube and the guide along the longitudinal axis of the rod toward and away from said first contact;

a releasable latch in the tube engageable with the rod for holding the rod at one end of its reciprocable path of travel remote from the first contact;

means operably connected to said latch for selectively releasing said latch for disengagement of said rod from said latch;

spring means in the tube for forcing the rod toward the opposite end of its path of travel upon release of said latch, said rod engaging both contacts when the rod is at said opposite end of its path of travel;

a collar surrounding the tube; and means interlocked with the collar and extending through the tube for holding the guide against displacement longitudinally of the tube.

4. The invention of claim 3; and a bushing in the tube surrounding the guide and being connected therewith, said guide holding means being interlocked with the bushing.

5. The invention of claim 4, the collar being split, presenting a pair of sections; and releasable fasteners interconnecting the sections.

6. A load pick-up tool for transferring electrical current from an energized conductor to a non-energized conductor, said tool comprising:

an elongated dielectric tube;

a conductive head secured to the tube at one end of the latter, said head having means for clamping the same to an energized conductor and being provided with a first, fixed electric contact;

an elongated, tubular, conductive guide in the tube spaced from said head;

means holding the guide against movement relative to the tube toward and away from the head, said guide having means for connecting the same to a non-energized conductor and being provided with a second, fixed electric contact;

an elongated, conductive rod in the guide, said guide supporting the rod for rectilinear reciprocation longitudinally of the tube and the guide along the longitudinal axis of the rod toward and away from said first contact;

a releasable latch in the tube engageable with the rod for holding the rod at one end of its reciprocable path of travel remote from the first contact;

means operably connected to said latch for selectively releasing said latch for disengagement of said rod from said latch;

spring means in the tube for forcing the rod toward the opposite end of its path of travel upon release of said latch, said rod engaging both contacts when the rod is at said opposite end of its path of travel, said rod being in sliding engagement with the second contact during reciprocation of the rod;

both contacts being in surrounding engagement with the rod when the latter is at said opposite end of its path of travel;

a disc guide for the rod surrounding the latter and secured thereto, said disc guide slidably engaging the tube therewithin during reciprocation of the rod; and stop means within the tube disposed for engagement by said disc guide for limiting the extend of movement of the rod toward said first contact.

7. A load pick-up tool for transferring electrical current from an energized conductor to a non-energized conductor, said tool comprising:

an elongated dielectric tube;

a conductive head secured to the tube at one end of the latter;

said head having means for clamping the same to an energized conductor and being provided with a first, fixed electric contact;

an elongated, tubular, conductive guide in the tube spaced from said head;

means holding the guide against movement relative to the tube toward and away from the head, said guide having means for connecting the same to a non-energized conductor and being provided with a second, fixed electric contact;

an elongated, conductive rod in the guide, said guide supporting the rod for recitlinear reciprocation longitudinally of the tube and the guide along the longitudinal axis of the rod toward and away from said first contact;

a releasable latch in the tube engageable with the rod for holding the rod at one end of its reciprocable path of travel remote from the first contact;

means operably connected to said latch for selectively releasing said latch for disengagement of said rod from said latch;

spring means in the tube for forcing the rod toward the opposite end of its path of travel upon release of said latch, said rod engaging both contacts when the rod is at said opposite end of its path of travel, said rod being in sliding engagement with the second contact during reciprocation of the rod;

both contacts being in surrounding engagement with the rod when the latter is at said opposite end of its path of travel; and a disc guide for the rod surrounding the latter and secured thereto, said disc guide slidably engaging the tube therewithin during reciprocation of the rod;

said conductive guide having an elongated, rod-receiving bore coaxial with the tube, said spring being coiled about the rod between the guides;

said head having a passage therethrough for receiving an elongated device used to push the rod to said one end of its path of travel against the action of the spring.

8. The invention of claim 7, the first contact being within said passage, the second contact being within the bore.

* * * * *